US007590371B2

(12) United States Patent
Suzuki

(10) Patent No.: US 7,590,371 B2
(45) Date of Patent: Sep. 15, 2009

(54) IMAGE CARRYING CARTRIDGE, PROCESS CARTRIDGE, AND IMAGE-FORMING DEVICE

(75) Inventor: Tsutomu Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 435 days.

(21) Appl. No.: 11/410,010

(22) Filed: Apr. 25, 2006

(65) Prior Publication Data

US 2006/0245786 A1 Nov. 2, 2006

(30) Foreign Application Priority Data

Apr. 27, 2005 (JP) ..... 2005-130201

(51) Int. Cl.
*G03G 21/16* (2006.01)

(52) U.S. Cl. ..... 399/111; 399/115; 399/116; 399/117

(58) Field of Classification Search ..... 399/111, 399/115, 116, 117
See application file for complete search history.

(56) References Cited

U.S. PATENT DOCUMENTS 4,757,342 A 7/1988 Ogura et al.
5,758,243 A 5/1998 Haneda et al.
7,050,738 B2 5/2006 Amanai
2005/0031374 A1* 2/2005 Nagashima et al. ..... 399/117
2005/0191089 A1* 9/2005 Nishimura ..... 399/111

FOREIGN PATENT DOCUMENTS

| | | |
|---|---|---|
| JP | A-62-153964 | 7/1987 |
| JP | U-7-19752 | 4/1995 |
| JP | A-2000-298386 | 10/2000 |
| JP | A-2002-149036 | 5/2002 |
| JP | A-2002-196651 | 7/2002 |
| JP | A-2002-333810 | 11/2002 |

* cited by examiner

*Primary Examiner*—David M Gray
*Assistant Examiner*—Bryan P Ready
(74) *Attorney, Agent, or Firm*—Oliff & Berridge, PLC

(57) ABSTRACT

An image carrying cartridge includes a shaft, an image carrying member, a first casing, and a second casing. The image carrying member is formed with a shaft insertion-hole through which the shaft is inserted. The first casing includes two first walls formed with a first through-hole. Each of the first walls opposes each end of the image carrying member in a axial direction of the shaft. The second casing includes two second walls formed with a second through-hole. Each of the second walls opposes each of the first walls in the axial direction. The first casing and the second casing are coupled by insertion of the shaft through the first though-hole and the second through-hole to provide an inner space in which the image carrying member is accommodated.

7 Claims, 9 Drawing Sheets

IMAGE CARRYING CARTRIDGE, PROCESS CARTRIDGE, AND IMAGE-FORMING DEVICE

CROSS REFERENCE TO RELATED APPLICATIONS

This application claims priority from Japanese Patent Application No. 2005-130201 filed Apr. 27, 2005. The entire content of priority application is incorporated herein by reference.

TECHNICAL FIELD

The present invention relates to an image-forming device, such as a laser printer, and to an image carrying cartridge and process cartridge mounted in the image-forming device.

BACKGROUND

In an image-forming device such as a laser printer, a charger, a developer, and a transfer roller are disposed around a photosensitive drum. When the photosensitive drum is rotated, the surface of the photosensitive drum is uniformly charged by the charger and then selectively exposed by a laser beam. As a result, the electric charge on the surface of the photosensitive drum is partially removed and a latent image is formed on the surface of the photosensitive drum. When the latent image formed on the surface of the photosensitive drum rotates opposite the developer, toner carried on the developer is supplied to the latent image and the latent image is developed into a toner image. Subsequently, when the toner image is rotated opposite a transfer roller, the toner image carried on the photosensitive drum is transferred onto a sheet of paper conveyed between the photosensitive drum and the transfer roller.

In order to form an excellent latent image and toner image on the surface of the photosensitive drum, as well as to transfer the toner image onto a paper with high accuracy, the relative positional relationship between the photosensitive drum and components disposed around the photosensitive drum, such as the charger, is very important in such image-forming device.

An image-forming device disclosed in Japanese Utility Model Publication No. HEI-7-19752 provides a first casing including a photosensitive drum and a second casing including a charger. In the image-forming device, a relative position between the photosensitive drum and the charger is positioned by attaching the first casing and the second casing. The second casing has an engagement portion to be engaged with a shaft of the photosensitive drum. The first casing has a claw portion to be locked a locking hole formed in the first casing. When the engagement portion is engaged with the shaft of the photosensitive drum, and the claw portion is locked the locking hole, engagement between the first and second casings is achieved.

SUMMARY

However, the engagement portion and the claw portion have errors in shape or dimension (manufacturing error) respectively. When the first and second casings are attached together, the errors in shape or dimension of the engagement portion and claw portion are summed together. Accordingly, There is a possibility that the claw portion cannot be locked into the locking hole.

Further, once the first and second casings are attached together, removal of the claw portion from the locking hole is made difficult. Therefore, replacement of components such as the photosensitive drum is troublesome after the first and second casings are attached together.

In view of the foregoing, it is an object of the present invention to provide an image-forming device and a image carrying cartridge and a process cartridge used in the image-forming device capable of positioning a relative position between a image carrying member and components disposed around the image carrying member with high accuracy, and reducing a work at the time of assembly and separation.

To achieve the above and other objects, one aspect of the present invention provides an image carrying cartridge including a shaft, an image carrying member, a first casing, and a second casing.

The shaft defines an axial direction. The image carrying member carries a developer image. The image carrying member is formed with a shaft insertion-hole extending in the axial direction through which the shaft is inserted and has one end and another end in the axial direction. The first casing includes two first walls arranged in parallel to each other and having surfaces perpendicular to the axial direction of the shaft. One first wall opposes the one end of the image carrying member in the axial direction, another first wall opposes the another end of the image carrying member in the axial direction. Each of the first walls is formed with a first through-hole. The second casing includes two second walls arranged in parallel to the two first walls. One second wall opposes the one first wall in the axial direction, another second wall opposing the another first wall in the axial direction. Each of the second walls is formed with a second through-hole. The first casing and the second casing are coupled by insertion of the shaft through the first though-hole and the second through-hole to provide an inner space in which the image carrying member is accommodated.

In another aspect of the invention, there is provided a process cartridge including above-described image carrying cartridge and a developer cartridge that supplies a toner to the image carrying member.

In another aspect of the invention, there is provided an image forming device including a main frame and above-described image carrying cartridge disposed in the main frame.

In another aspect of the invention, there is provided an image forming device including a main frame and above-described process cartridge provided in the main frame.

DETAILED DESCRIPTION

Next, a laser printer as an image-forming device according to an embodiment of the present invention will be described while referring to the accompanying drawings.

Figure 1:
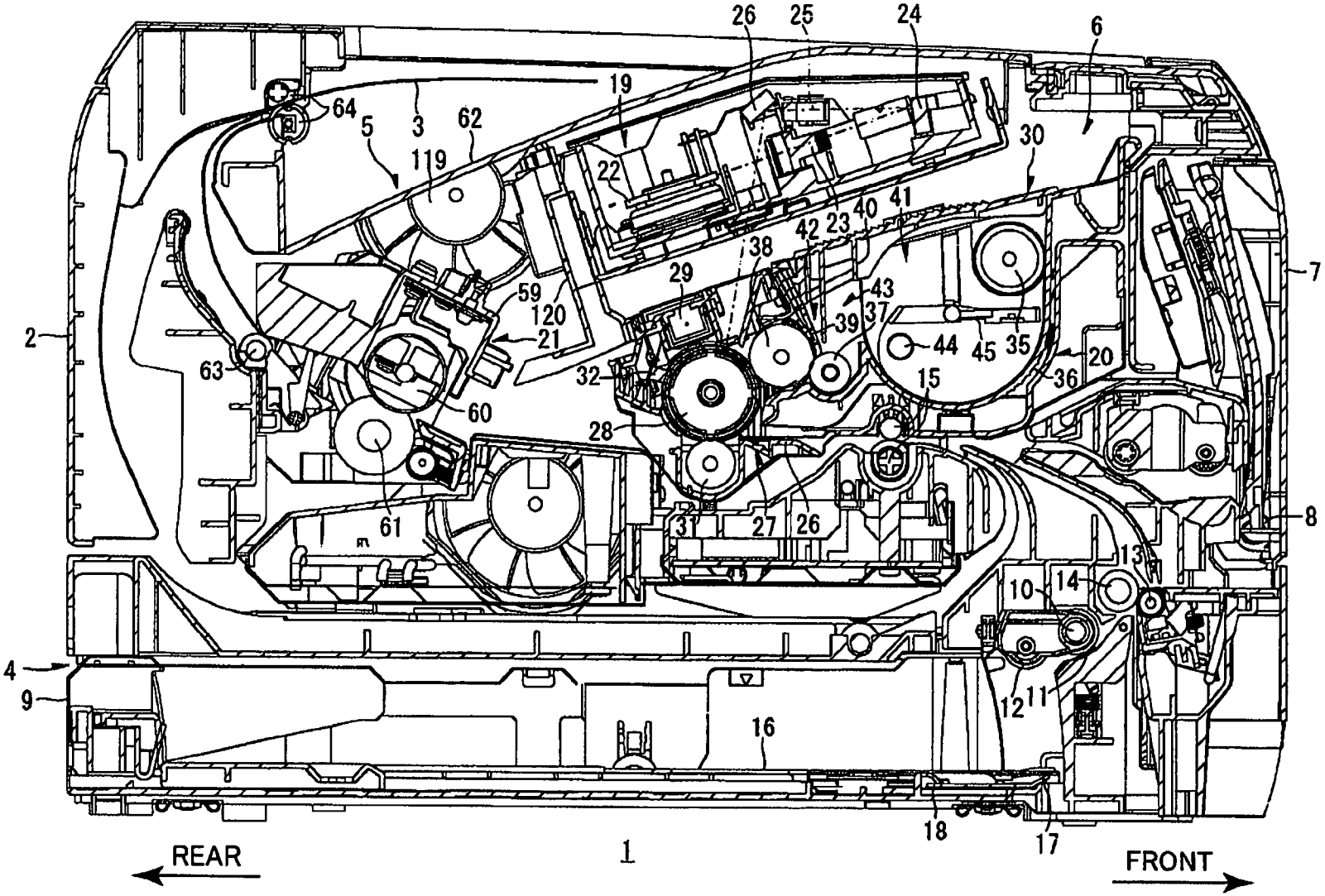
FIG. 1 is a side cross-sectional view of a laser printer serving as the image-forming device of the present invention.

As shown in FIG. 1, the laser printer 1 includes a main casing 2 and, within the main casing 2, a feeding unit 4 for supplying sheets of a paper 3, an image-forming unit 5 for forming images on the paper 3 supplied by the feeding unit 4.

The laser printer 1 also includes an access opening 6 formed in one side wall of the main casing 2 for inserting and removing a process cartridge 20 described later, and a front cover 7 capable of opening and closing over the access opening 6. The front cover 7 is rotatably supported by a cover shaft 8 inserted through a bottom edge of the front cover 7. Accordingly, when the front cover 7 is rotated closed about the cover shaft 8, the front cover 7 covers the access opening 6, as shown in FIG. 1. When the front cover 7 is rotated open about the cover shaft 8, the access opening 6 is exposed, enabling the process cartridge 20 to be mounted into or removed from the main casing 2 via the access opening 6.

In the following description, the side of the laser printer 1 on which the front cover 7 is mounted and the corresponding side of the process cartridge 20 when the process cartridge 20 is mounted in the main casing 2 will be referred to as the "front side," while the opposite side will be referred to as the "rear side."

The main casing 2 is also provided with an exhausting fan 119 for exhausting air out of the main casing 2, and a duct 120 for guiding air to the exhausting fan 119.

The feeding unit 4 includes a paper tray 9 that can be inserted into or removed from a lower section of the main casing 2 in the front-to-rear direction, a separating roller 10 and a separating pad 11 disposed above a front end of the paper tray 9, and a feeding roller 12 disposed on the rear side of the separating roller 10 upstream of the separating pad 11 with respect to the conveying direction of the paper 3 (hereinafter referred to as the "paper-conveying direction"). The feeding unit 4 also includes a paper dust roller 13 disposed above and forward of the separating roller 10 and downstream of the separating roller 10 in the paper-conveying direction, and a pinch roller 14 disposed in opposition to the paper dust roller 13.

A paper-conveying path for the paper 3 reverses directions toward the rear side of the laser printer 1, forming a substantial U-shape near the paper dust roller 13. The feeding unit 4 also includes a pair of registration rollers 15 disposed below the process cartridge 20 farther downstream of the U-shaped portion of the paper-conveying path with respect to the paper-conveying direction.

A paper-pressing plate 16 is provided inside the paper tray 9 for supporting the paper 3 in a stacked state. The paper-pressing plate 16 is pivotably supported on the rear end thereof, so that the front end can pivot downward to a resting position in which the paper-pressing plate 16 rests on a bottom plate of the paper tray 9 and can pivot upward to a feeding position in which the paper-pressing plate 16 slopes upward from the rear end to the front end.

A lever 17 is provided in the front section of the paper tray 9 for lifting the front end of the paper-pressing plate 16 upward. The rear end of the lever 17 is pivotably supported on a lever shaft 18 at a position below the front end of the paper-pressing plate 16 so that the front end of the lever 17 can pivot between a level position in which the lever 17 lies along the bottom plate of the paper tray 9 and a sloped position in which the front end of the lever 17 lifts the paper-pressing plate 16 upward. When a driving force is inputted into the lever shaft 18, the lever 17 rotates about the lever shaft 18 and the front end of the lever 17 raises the front end of the paper-pressing plate 16, shifting the paper-pressing plate 16 into the feeding position.

When the paper-pressing plate 16 is in the feeding position, the topmost sheet of paper 3 stacked on the paper-pressing plate 16 is pressed against the feeding roller 12. The rotating feeding roller 12 begins feeding the sheets of paper 3 toward a separating position between the separating roller 10 and separating pad 11.

When the paper tray 9 is removed from the main casing 2, the paper-pressing plate 16 settles into the resting position. While the paper-pressing plate 16 is in the resting position, the paper 3 can be stacked on the paper-pressing plate 16.

When the feeding roller 12 conveys a sheet of the paper 3 toward the separating position and the sheet becomes interposed between the separating roller 10 and separating pad 11, the rotating separating roller 10 separates and feeds the paper 3 one sheet at a time. Each sheet of paper 3 fed by the separating roller 10 passes between the paper dust roller 13 and pinch roller 14. After the paper dust roller 13 removes paper dust from the sheet of paper 3, the sheet is conveyed along the U-shaped paper-conveying path, thereby reversing directions in the main casing 2, and is conveyed toward the registration rollers 15.

After registering the paper 3, the registration rollers 15 convey the paper 3 to a transfer position between a photosensitive drum 28 and a transfer roller 31 described later, at which position a toner image formed on the photosensitive drum 28 is transferred onto the paper 3.

The image-forming unit 5 includes a scanning unit 19, the process cartridge 20, and a fixing unit 21.

The scanning unit 19 is disposed in a top section of the main casing 2 and includes a laser light source (not shown), a polygon mirror 22 that can be driven to rotate, an fθ lens 23, a reflecting mirror 24, a lens 25, and a reflecting mirror 26. The laser light source emits a laser beam based on image data. As illustrated by a dotted line in FIG. 1, the laser beam is deflected by the polygon mirror 22, passes through the fθ lens 23, is reflected by the reflecting mirror 24, passes through the lens 25, and is reflected downward by the reflecting mirror 26 to be irradiated on the surface of the photosensitive drum 28 in the process cartridge 20.

Figure 2:
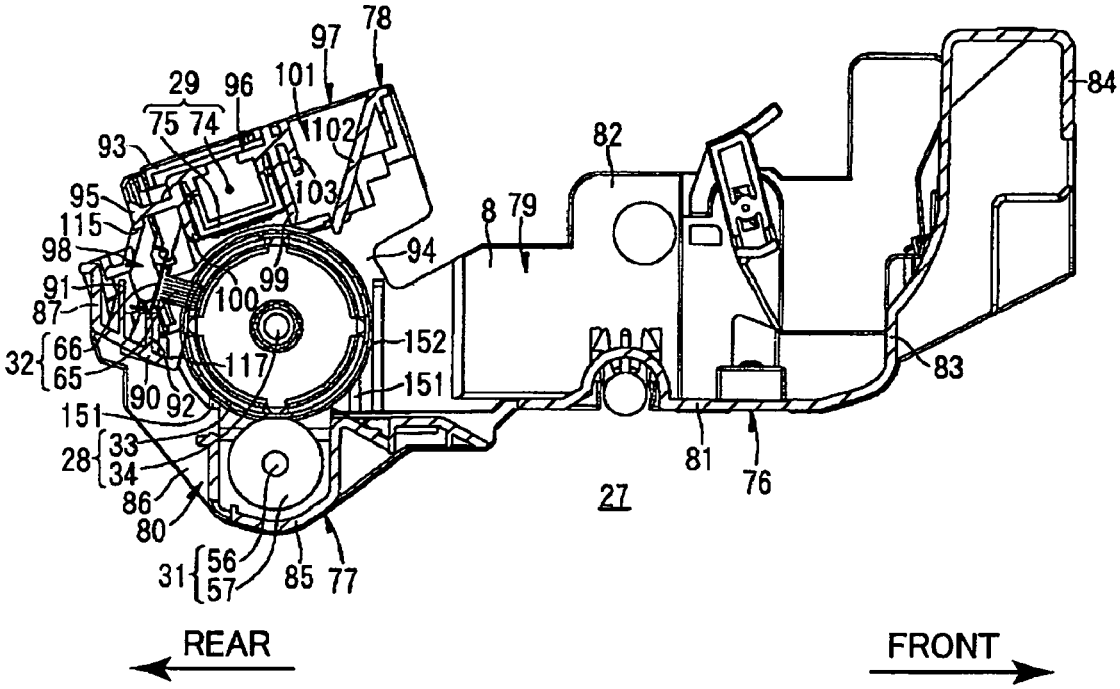
FIG. 2 is a side cross-sectional view of a process cartridge employed in the laser printer shown in FIG. 1.
Figure 3:
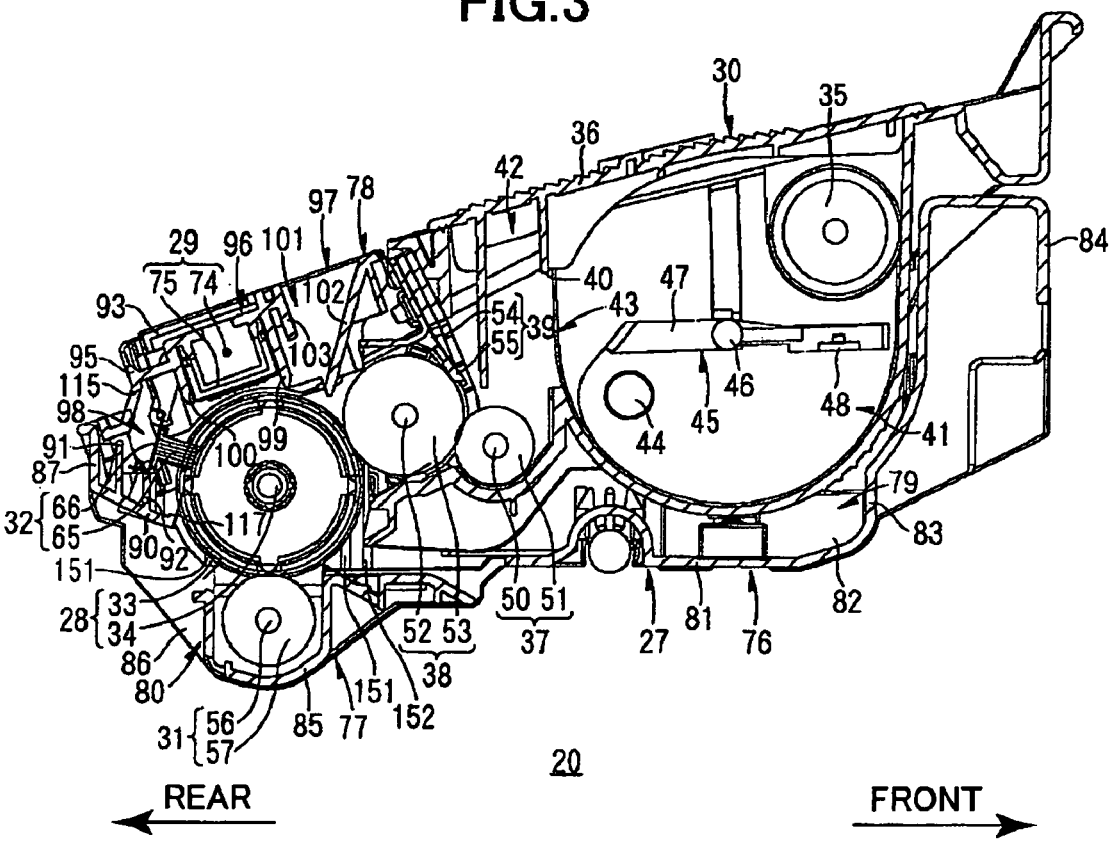
FIG. 3 is a side cross-sectional view of a process cartridge employed in the laser printer shown in FIG. 1.

As shown in FIG. 1, the process cartridge 20 is provided in the main casing 2 beneath the scanning unit 19 and can be mounted in or removed from the main casing 2 through the access opening 6. As shown in FIG. 3, the process cartridge 20 includes a drum cartridge 27 and a developer cartridge 30 that is detachably mounted on the drum cartridge 27. As shown in FIG. 2, the drum cartridge 27 includes a drum side casing 76 described later in greater detail and, within the drum side casing 76, the photosensitive drum 28, a Scorotron charger 29, the transfer roller 31, and a cleaning member 32.

The photosensitive drum 28 includes a main drum body 33 that is cylindrical in shape and has a positive charging photosensitive layer formed of polycarbonate or the like on its outer surface, and a metal drum shaft 34 extending through the center of the main drum body 33 along the axial direction thereof. The metal drum shaft 34 is supported in the drum side casing 76, and the main drum body 33 is rotatably supported relative to the metal drum shaft 34. With this construction, the photosensitive drum 28 is disposed in the drum side casing 76 and is capable of rotating about the metal drum shaft 34. Further, the photosensitive drum 28 is driven to rotate by a driving force inputted from a motor (not shown).

The charger 29 is supported on the drum side casing 76 diagonally above and rearward of the photosensitive drum 28. The charger 29 opposes the photosensitive drum 28 but is separated a prescribed distance from the photosensitive drum 28 so as not to contact the same. The charger 29 includes a discharge wire 74 disposed in opposition to but separated a prescribed distance from the photosensitive drum 28, and a grid 75 provided between the discharge wire 74 and the photosensitive drum 28 for controlling the amount of corona discharge from the discharge wire 74 that reaches the photosensitive drum 28. By applying a high voltage to the discharge wire 74 for generating a corona discharge from the discharge wire 74 at the same time a bias voltage is applied to the grid 75, the charger 29 can charge the surface of the photosensitive drum 28 with a uniform positive polarity.

The transfer roller 31 is disposed in the drum side casing 76 below the photosensitive drum 28 and contacts the photosensitive drum 28 in a vertical direction from the bottom thereof so as to form a nip part with the photosensitive drum 28. The transfer roller 31 is configured of a metal roller shaft 56 that is covered with a roller 57 formed of an electrically conductive rubber material. The roller shaft 56 is rotatably supported in the drum side casing 76. The transfer roller 31 is driven to rotate by a driving force inputted from a motor (not shown). Further, a transfer bias is applied to the transfer roller 31 during a transfer operation.

The cleaning member 32 is mounted on the drum side casing 76 in a position confronting and contacting the photosensitive drum 28 from the rear side thereof. The cleaning member 32 includes a cleaning brush 65 that captures paper dust deposited on the photosensitive drum 28, and a support plate 66 that supports the rear side of the cleaning brush 65 on the side opposite the photosensitive drum 28.

The cleaning brush 65 is configured of a nonwoven fabric implanted with a plurality of fibrous brush bristles having electrical conductivity, and is fixed to the support plate 66. The cleaning brush 65 is disposed so as to confront and contact the photosensitive drum 28. The support plate 66 is supported on the drum side casing 76 while supporting the cleaning brush 65. A cleaning bias is applied to the cleaning member 32 during cleaning operation.

As shown in FIG. 3, the developer cartridge 30 is detachably mounted to the drum side casing 76. Accordingly, when the process cartridge 20 is mounted in the main casing 2, the developer cartridge 30 can be mounted in the main casing 2 by first opening the front cover 7 and subsequently inserting the developer cartridge 30 through the access opening 6 and mounting the developer cartridge 30 on the process cartridge 20.

The developer cartridge 30 includes a developer side casing 36 and, within the developer side casing 36, a supply roller 37, a developing roller 38, and a thickness-regulating blade 39. The developer side casing 36 has a box shape that is open on the rear side. A partitioning wall 40 is provided in the developer side casing 36 for partitioning the interior of the developer side casing 36 into a toner-accommodating chamber 41 and a developing chamber 42. The partitioning wall 40 is disposed at a position in the developer side casing 36 midway in the front-to-rear direction for partitioning the interior of the developer side casing 36 in the front-to-rear direction. An opening 43 is formed through a midway region of the partitioning wall 40.

The toner-accommodating chamber 41 occupies a space in the front side of the developer side casing 36 partitioned by the partitioning wall 40. The toner-accommodating chamber 41 is filled with a nonmagnetic, single-component toner having a positive charge. The toner used in the preferred embodiment is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, or wax, as well as an additive such as silica to improve fluidity. The average diameter of the toner particles is about 6-10 μm.

Toner supply openings for filling the toner-accommodating chamber 41 with toner are formed in both side walls of the developer side casing 36 that define the toner-accommodating chamber 41. The toner supply openings are sealed with caps 35.

Toner detection windows 44 are provided in both side walls of the developer side casing 36 that define the toner-accommodating chamber 41 for detecting the amount of toner remaining in the toner-accommodating chamber 41. The toner detection windows 44 are formed in the side walls near the partitioning wall 40 and oppose each other in the width direction W (the direction orthogonal to the front-to-rear direction and the vertical) across the toner-accommodating chamber 41. The toner detection windows 44 are formed by embedding a transparent disc-shaped plate in each side wall.

An agitator 45 is disposed in the toner-accommodating chamber 41 for agitating toner accommodated therein. The agitator 45 includes a rotational shaft 46 and an agitating member 47.

The rotational shaft 46 is rotatably supported in the side walls of the developer side casing 36 substantially in the center of the toner-accommodating chamber 41. The agitating member 47 is provided on the rotational shaft 46. A motor (not shown) produces a driving force that is inputted into the rotational shaft 46 for driving the rotational shaft 46 to rotate. Consequently, the agitating member 47 moves in a circular path about the rotational shaft 46 through the toner-accommodating chamber 41 and stirs toner accommodated in the toner-accommodating chamber 41. When the agitating member 47 stirs the toner, some of the toner is discharged in the front-to-rear direction toward the supply roller 37 through the opening 43 formed in the partitioning plate 40.

The agitator 45 also includes wipers 48 attached at both axial ends of the rotational shaft 46. When the rotational shaft 46 rotates, the wipers 48 move in a circular direction about the rotational shaft 46 through the toner-accommodating chamber 41 in order to wipe the toner detection windows 44 provided in the side walls of the developer side casing 36. Hence, the wipers 48 function to clean the toner detection windows 44.

The developing chamber 42 occupies an interior space in the rear side of the developer side casing 36 partitioned by the partitioning wall 40. The developing chamber 42 accommodates the supply roller 37, the developing roller 38, and the thickness-regulating blade 39.

The supply roller 37 is disposed rearward of the opening 43 and includes a metal roller shaft 50 covered by a sponge roller 51 formed of an electrically conductive foam material. The roller shaft 50 is rotatably supported within the developing chamber 42 in both side walls of the developer side casing 36. The supply roller 37 is driven to rotate by a driving force inputted into the roller shaft 50 from a motor (not shown).

The developing roller 38 is disposed rearward of the supply roller 37 and contacts the supply roller 37 with pressure so that both are compressed. The developing roller 38 includes a metal roller shaft 52, and a rubber roller 53 formed of an electrically conductive rubber material that covers the roller shaft 52. The roller shaft 52 is rotatably supported in both side walls of the developer side casing 36 within the developing chamber 42. The rubber roller 53 is more specifically formed of an electrically conductive urethane rubber or silicon rubber containing fine carbon particles, the surface of which is coated with urethane rubber or silicon rubber containing fluorine. The developing roller 38 is driven to rotate by a driving force inputted into the roller shaft 52 from a motor (not shown). Further, a developing bias is applied to the developing roller 38 during a developing operation.

The thickness-regulating blade 39 includes a main blade member 54 configured of a metal leaf spring, and a pressing part 55 provided on a distal end of the main blade member 54. The pressing part 55 has a semicircular cross section and is formed of an insulating silicon rubber. A base end of the main blade member 54 is supported on the developer side casing 36 above the developing roller 38, and the pressing part 55 contacts the developing roller 38 with pressure through the elastic force of the main blade member 54.

Toner discharged through the opening 43 is supplied onto the developing roller 38 by the rotating supply roller 37. At this time, the toner is positively tribocharged between the supply roller 37 and the developing roller 38. As the developing roller 38 rotates, the toner supplied to the surface of the developing roller 38 passes between the rubber roller 53 of the developing roller 38 and the pressing part 55 of the thickness-regulating blade 39, thereby maintaining a uniform thickness of toner on the surface of the developing roller 38.

As the photosensitive drum 28 rotates, the charger 29 charges the surface of the photosensitive drum 28 with a uniform positive polarity. Subsequently, a laser beam emitted from the scanning unit 19 is scanned at a high speed over the surface of the photosensitive drum 28, forming an electrostatic latent image corresponding to an image to be formed on the paper 3.

Next, positively charged toner carried on the surface of the developing roller 38 comes into contact with the photosensitive drum 28 as the developing roller 38 rotates and is supplied to areas on the surface of the positively charged photosensitive drum 28 that were exposed to the laser beam and, therefore, have a lower potential. In this way, the latent image on the photosensitive drum 28 is transformed into a visible image according to a reverse developing process so that a toner image is carried on the surface of the photosensitive drum 28.

Subsequently, as the registration rollers 15 convey a sheet of the paper 3 through the transfer position between the photosensitive drum 28 and the transfer roller 31, the toner image carried on the surface of the photosensitive drum 28 is transferred onto the paper 3 by the transfer bias applied to the transfer roller 31. After the toner image is transferred, the paper 3 is conveyed to the fixing unit 21.

Toner remaining on the photosensitive drum 28 after the transfer operation is recovered by the developing roller 38. Further, paper dust deposited on the photosensitive drum 28 from the paper 3 is recovered by the cleaning brush 58 of the cleaning member 32. Further, the cleaning brush 65 of the cleaning member 32 physically scrapes off and electrically absorbs paper dust after the transfer process that was deposited from the paper 3 onto the surface of the photosensitive drum 28.

The fixing unit 21 is disposed on the rear side of the process cartridge 20 and includes a fixed frame 59, and a heating roller 60 and a pressure roller 61 provided within the fixed frame 59.

The heating roller 60 includes a metal tube, the surface of which has been coated with a fluorine resin, and a halogen lamp disposed inside the metal tube for heating the same. The heating roller 60 is driven to rotate by a driving force inputted from a motor (not shown).

The pressure roller 61 is disposed below and in opposition to the heating roller 60 and contacts the heating roller 60 with pressure. The pressure roller 61 is configured of a metal roller shaft covered with a roller that is formed of a rubber material. The pressure roller 61 follows the rotational drive of the heating roller 60.

In the fixing unit 21, a toner image transferred onto the paper 3 at the transfer position is fixed to the paper 3 by heat as the paper 3 passes between the heating roller 60 and pressure roller 61. After the toner image is fixed to the paper 3, the heating roller 60 and pressure roller 61 continue to convey the paper 3 along a discharge end paper-conveying path toward a discharge tray 62 formed on the top surface of the main casing 2.

The paper-conveying path on the discharge end leads from the fixing unit 21 to the discharge tray 62 and is substantially U-shaped for reversing the conveying direction of the paper 3 to a direction toward the front side of the laser printer 1. A pair of conveying rollers 63 is disposed at a midpoint along the discharge end paper-conveying path, and a pair of discharge rollers 64 is disposed at a downstream end of the same path.

Hence, after passing through the fixing unit 21, the paper 3 is conveyed along the discharge end paper-conveying path, where the conveying rollers 63 receive and convey the paper 3 to the discharge rollers 64, and the discharge rollers 64 subsequently receive and discharge the paper 3 onto the discharge tray 62.

Hot air generated from the heating roller 60 of the fixing unit 21 radiates and flows toward the photosensitive drum 28 of the process cartridge 20. However, since a bottom end of the duct 120 is positioned between the fixing unit 21 and the process cartridge 20, the duct 120 guides the hot air to the exhausting fan 119, and the exhausting fan 119 exhausts the air out of the main casing 2.

As shown in FIG. 2, the developer side casing 36 of the developer cartridge 30 has a box shape that is open on the rear side and is integrally provided with a top wall 70, a front wall 72, the two side walls 69 described above, and a bottom wall 71. The open region on the rear side is an opening 94.

Figure 5:
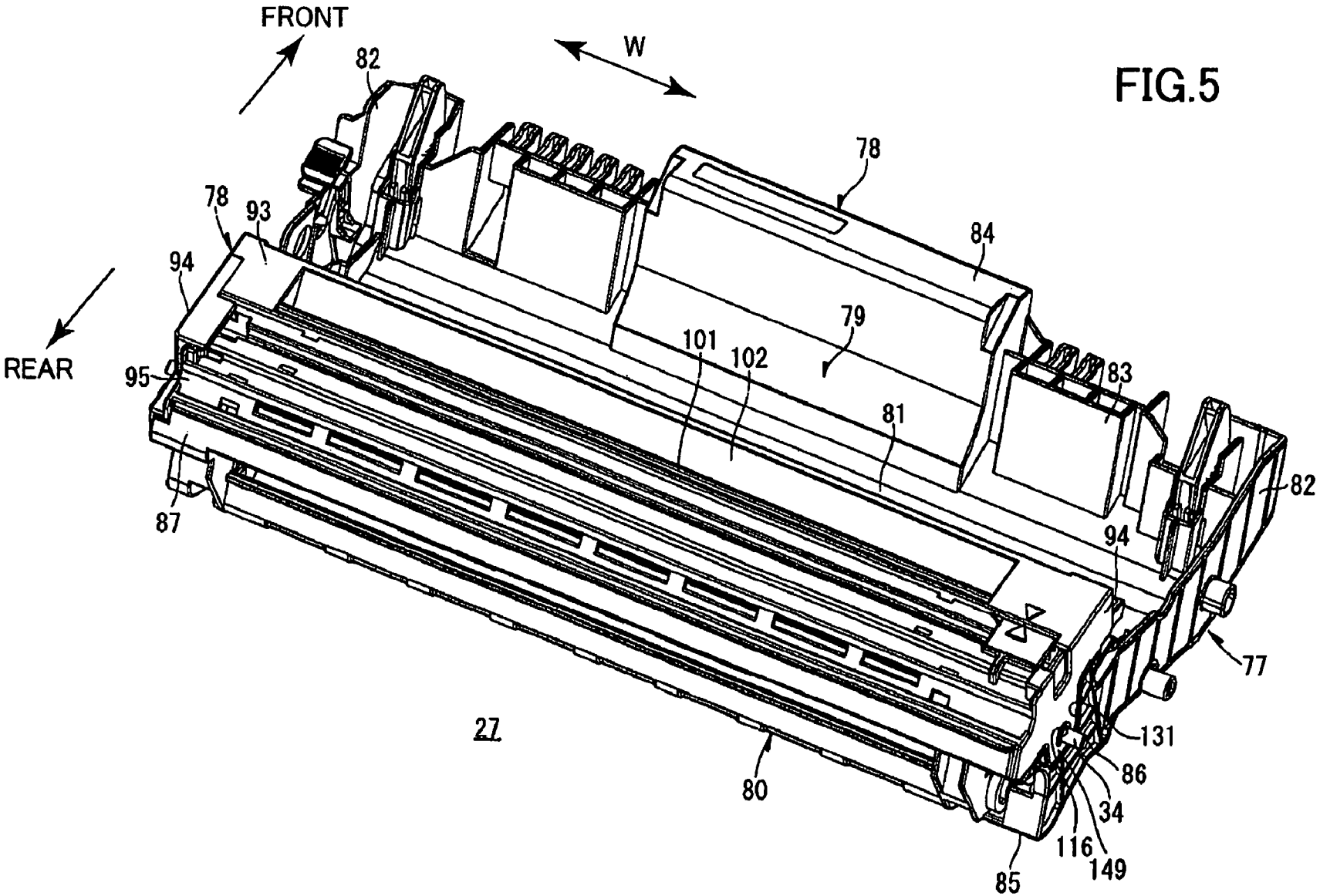
FIG. 5 is a perspective view from above the rear side of the drum cartridge according to the present invention.

As shown in FIG. 3, the opening 94 is defined by the back support member 111 of the mounting member 109, the rear edges of the side walls 69, and the rear edge of the bottom wall 71. When viewed from the rear side, the opening 94 is substantially rectangular and extends in the width direction W. The developing roller 38 is disposed in the opening 94 and is exposed therefrom. As shown in FIG. 5, the developing roller 38 is supported on the developer side casing 36 so as to protrude out of the developer side casing 36 via the opening 94 when viewed from the side. An insertion hole 121 is formed in the rear end of each side wall 69 of the developer side casing 36 at positions opposing each other in the width direction W. The roller shaft 52 of the developing roller 38 is inserted through the insertion holes 121 so that the developing roller 38 is rotatably supported on the developer side casing 36 with a vertical center portion of the rubber roller 53 protruding farthest out of the developer side casing 36 through the opening 94.

Figure 4:
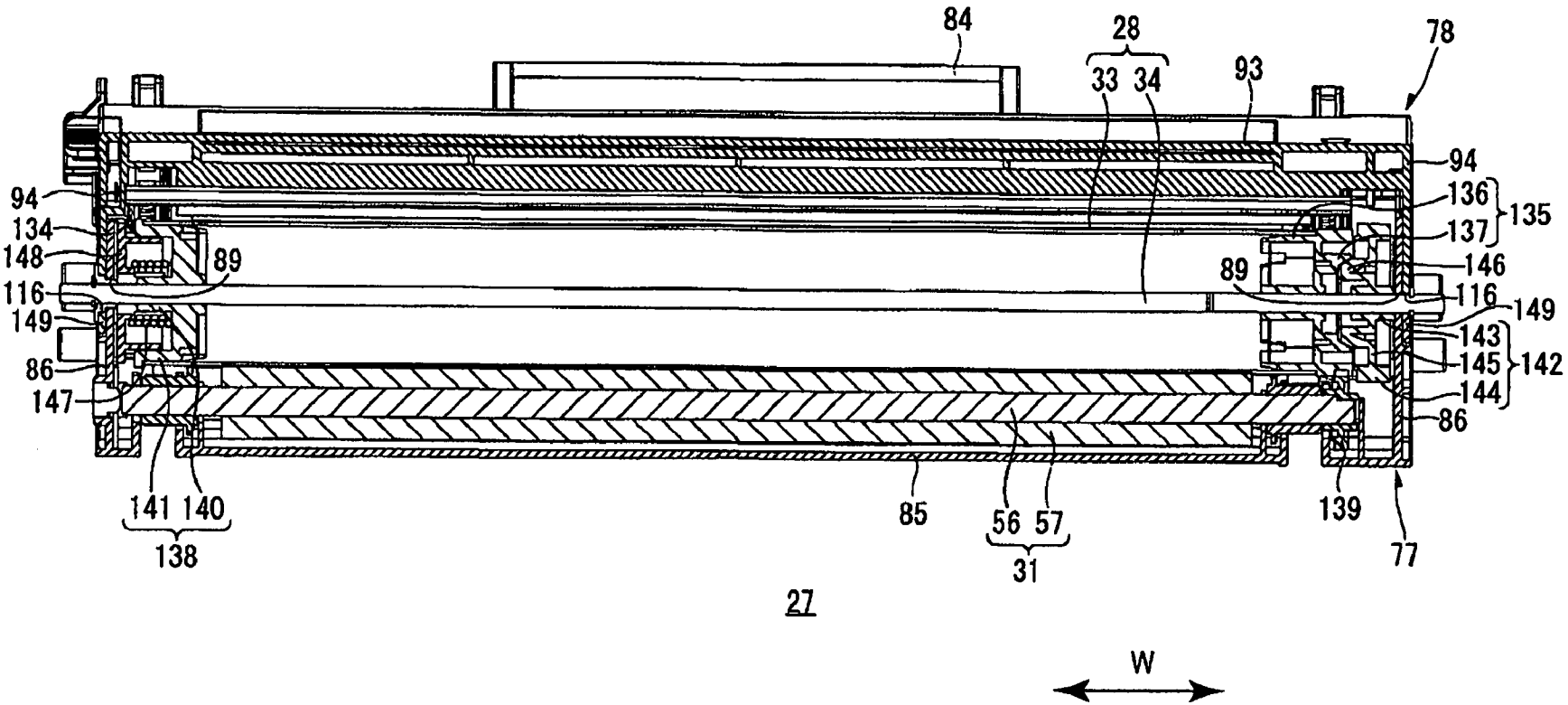
FIG. 4 is a cross-sectional view from the rear side of the drum cartridge taken along the vertical plane extending parallel to a drum shaft according to the present invention.
Figure 6:
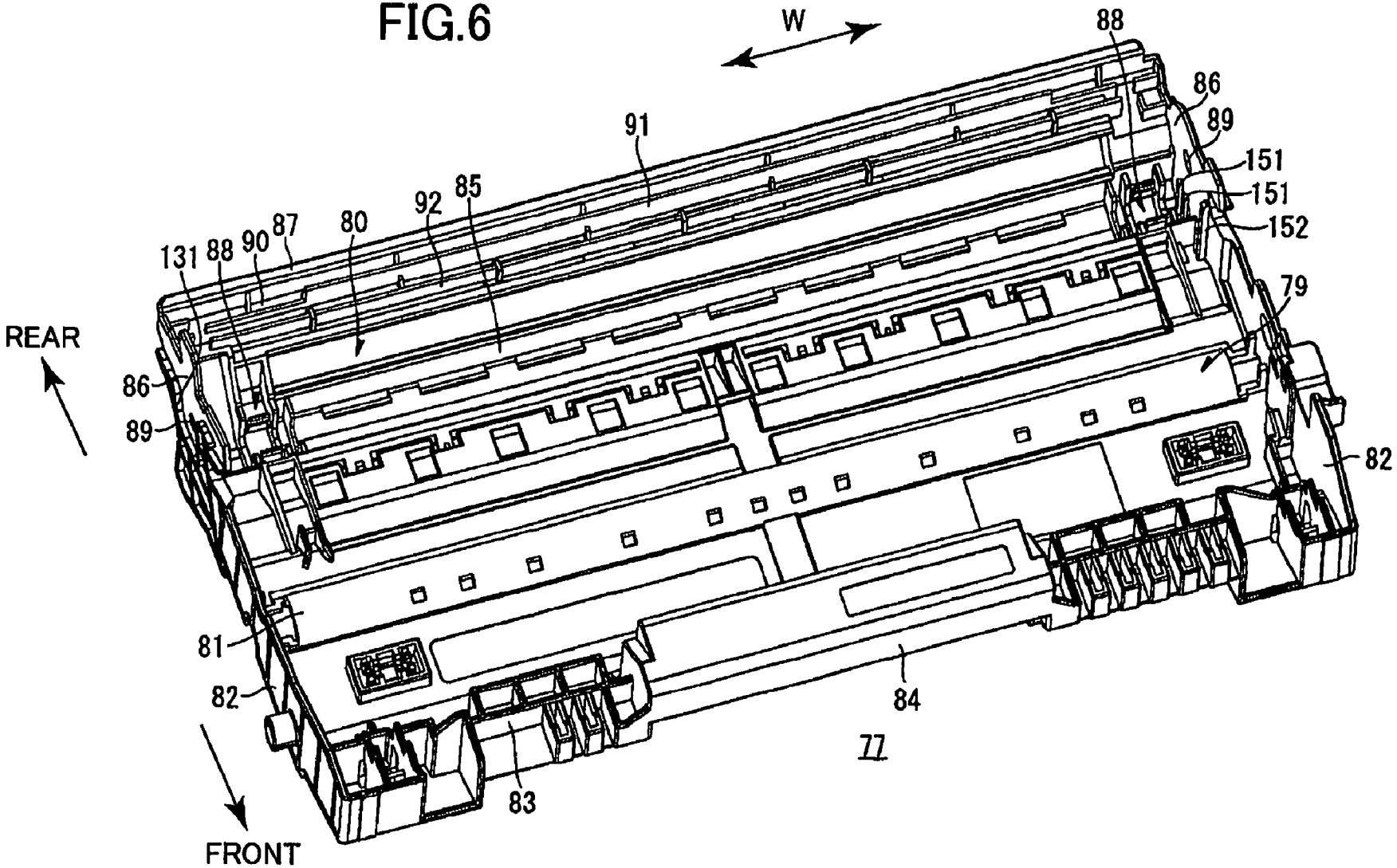
FIG. 6 is a perspective view from above the front side of a lower casing of the drum cartridge according to the present invention.
Figure 7:
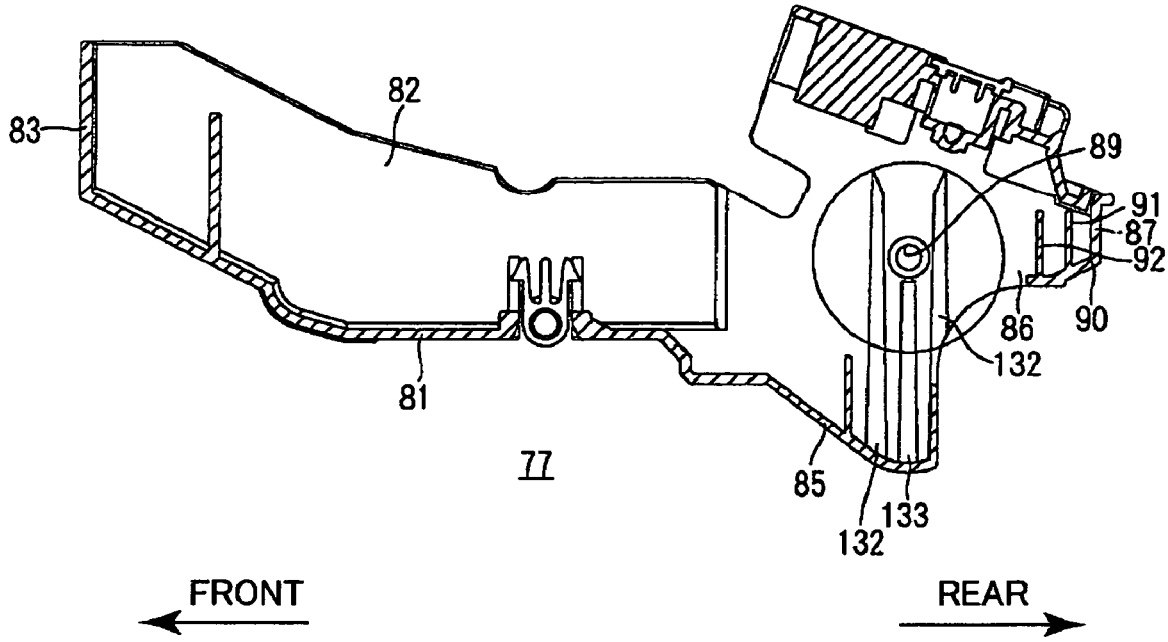
FIG. 7 is side cross-sectional view of the lower casing according to the present invention.

Next, the drum side casing 76 of the drum cartridge 27 will be described in detail with reference to FIGS. 1 through 7. FIG. 4 is a cross-sectional view from the rear side of the drum cartridge 27 taken along the vertical plane extending parallel to the drum shaft 34. FIG. 5 is a perspective view from above the rear side of the drum cartridge 27. FIG. 6 is a perspective view from above the front side of a lower casing 77 of the drum cartridge 27. FIG. 7 is a side cross-sectional view of the lower casing 77.

As shown in FIG. 2, the drum side casing 76 includes the lower casing 77, and an upper casing 78 formed separately from the lower casing 77 and assembled on top of the same. The upper casing 77 and the lower casing 78 is assembled to provide an inner space in which the photosensitive drum 28, the transfer roller 31, the charger 29, and the cleaning member 32.

As shown in FIGS. 2 and 6, the lower casing 77 is integrally provided with a developer cartridge mounting portion 79 disposed on the front side thereof for receiving the developer cartridge 30, and a drum support portion 80 disposed on the rear side thereof and positioned to vertically confront the upper casing 78.

As shown in FIGS. 2, 5 and 6, the developer cartridge mounting unit 79 is integrally provided with a front bottom wall 81 having substantially a rectangular plate shape for receiving the developer cartridge 30 (FIG. 3), two front side walls 82 disposed at each widthwise end of the front bottom wall 81 and opposing each other across the width of the front bottom wall 81, and a lower front wall 83 disposed on the front end of the front bottom wall 81. The developer cartridge mounting unit 79 is formed in a frame shape having a bottom and an open top. A handle 84 is formed in a widthwise center region of the lower front wall 83 for gripping the drum cartridge 27 when mounting or removing the same.

As shown in FIGS. 2, 5 and 6, the drum support unit 80 is integrally provided with a rear bottom wall 85 having a curved shape on the bottom thereof for receiving the transfer roller 31, two rear side walls 86 disposed on widthwise ends of the rear bottom wall 85 and opposing each other across the width of the rear bottom wall 85, and a lower rear wall 87 disposed on the rear edge of the rear bottom wall 85. The drum support unit 80 is formed in a frame shape having a bottom and an open top.

The front end of the rear bottom wall 85 is formed continuously with the rear edge of the front bottom wall 81, sagging downward in the center from the front edge to the rear edge so as to be substantially fan-shaped in a side view. Transfer roller receiving parts 88 are formed in both widthwise ends of the rear bottom wall 85 for receiving the transfer roller 31.

As shown in FIG. 6, two rear side walls 86 are bent upward from both widthwise edges of the rear bottom wall 85. Lower drum insertion holes 89 are formed in the rear side walls 86 at positions opposing each other in the width direction W for inserting the drum shaft 34 of the photosensitive drum 28.

Figure 8:
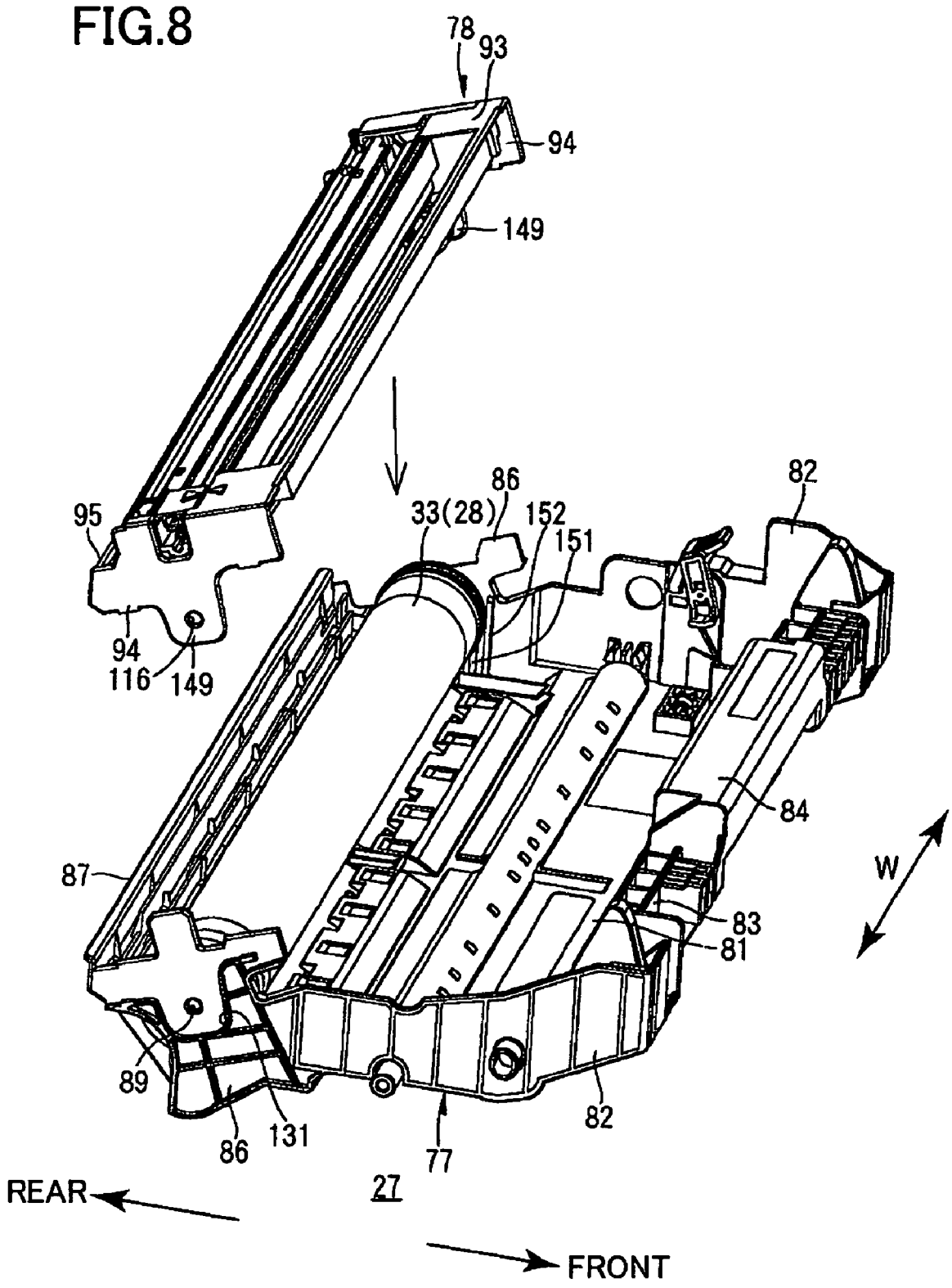
FIG. 8 is a view showing a process of assembling (upper casing is fitted to lower casing) the drum cartridge according to the present invention.

As shown in FIGS. 5 and 8, a receiving groove 131 is formed on the outer surface of each rear side wall 86 in the width direction W. When the upper casing 78 is attached to the lower casing 77, the receiving groove 131 receives a fitting portion 149 of the upper side wall 94 described later of the upper casing 78.

As shown in FIG. 7, a pair of guide ribs 132 is integrally provided on the inner surface of one rear side wall 86 (left side in the front view). When the photosensitive drum 28 is mounted on the lower casing 77, the pair of guide ribs 132 guides an edge of a bearing 143 of a drum gear 142 (FIG. 4) described later to a position where the edge of the bearing 143 overlaps the lower drum insertion hole 89 in the width direction W. The guide ribs 132, which are formed into a rib-shaped, protrude from the inner surface of the one rear side wall 86 toward the inside of the lower casing 77 in the width direction W, and extend in the vertical direction. The guide ribs 132 are disposed opposite to each other across the lower drum insertion hole 89 with a distance substantially equal to the outer diameter of the bearing 143 of the drum gear 142. A restriction rib 133 is provided on the inner surface of the one rear side wall 86 at a position between the pair of guide ribs 132. The restriction rib 133 prevents the bearing 143 of the drum gear 142 from being moved downward.

As shown in FIG. 4, a felt member 134 which a spring receiving member 148 described later contacts is disposed on the inner surface of the other rear side wall 86 (right side in the front view). A hole in communication with the lower drum insertion hole 89 is formed in the felt member 134. As shown in FIG. 2, two lower restriction ribs 151 and a front restriction rib 152 are formed on the inner surface of the other rear side wall 86. The two lower restriction ribs 151 contact a peripheral surface of a flange member 138 (FIG. 4) describe later from lower side, respectively, in a state where the photosensitive drum 28 is attached to the lower casing 77. The two lower restriction ribs 151 prevent the photosensitive drum 28 (flange member 138) from being moved downward. The front restriction rib 152 contacts the peripheral surface of the flange member 138 from the front side. The lower restriction ribs 151 and front restriction rib 152, which are formed into a rib-shaped, protrude from the inner surface of the other rear side wall 86 toward the inside of the lower casing 77 and extend in the vertical direction.

The lower rear wall 87 is formed continuously from the rear edge of the rear bottom wall 85 across the entire width between the rear side walls 86. The lower rear wall 87 is an elongated rectangular plate in the front view that is erected vertically and extends in the width direction W. As shown in FIGS. 2 and 6, a receiving plate 90 is formed continuously with the lower rear wall 87 and extends from the bottom edge of the lower rear wall 87 forward in a slightly downward slope.

An inner rear wall 91 and a positioning wall 92 are vertically erected from the receiving plate 90 forward of the lower rear wall 87 and are parallel to each other but separated a prescribed distance in the front-to-rear direction.

The inner rear wall 91 is disposed in front of and separated a prescribed interval from the lower rear wall 87. The inner rear wall 91 extends in the width direction W and is parallel to the lower rear wall 87. The positioning wall 92 also extends in the width direction W and is parallel to the inner rear wall 91. The positioning wall 92 is disposed in front of the inner rear wall 91 and is separated a prescribed distance therefrom. The positioning wall 92 functions to position the cleaning member 32.

As shown in FIG. 2, a film member 117 is disposed on the front end of the receiving plate 90 for contacting the photosensitive drum 28. The film member 117 is adhesively fixed to the end face on the front end of the receiving plate 90 and protrudes upward therefrom. The film member 117 extends in the width direction W and serves as a barrier between the receiving plate 90 and the photosensitive drum 28.

As shown in FIG. 4, the photosensitive drum 28 is disposed between both the rear side walls 86 of the lower casing 77. Flange members 135 and 138 are attached at both ends of the main drum body 33 of the photosensitive drum 28 respectively. The drum shaft 34 passes through the flange members 135 and 138 and rotatably supports the main drum body 33 through the flange members 135 and 138.

Each of the flange members 135 and 138 is formed of an insulating resin material. The flange member 135 is fixed to one end (left side end in the front view, but right side end in FIG. 4) of the main drum body 33. The flange member 135 is integrally formed with an insertion portion 136 to be inserted into the main drum body 33 and an exposed portion 137 which is exposed from the main drum body 33. The exposed portion 137 is formed in substantially a double cylindrical shape. The inner cylinder of the exposed portion 137 serves as a coupling portion for coupling to the drum gear 142. An outer teeth portion is formed on the peripheral surface of the outer cylinder of the exposed portion 137. The outer teeth portion is engaged with a transfer gear 139 attached to one end of the transfer roller shaft 56 of the transfer roller 31. Since the insertion section 136 of the flange member 135 is pressed into the main drum body 33, the flange member 135 is incapable of rotating relative to the main drum body 33.

The drum gear 142 is fixed to the flange member 135. A rotational drive force of the photosensitive drum 28 is transmitted to the drum gear 142. The drum gear 142 is integrally provided with the bearing 143, an input gear 144, and a coupling portion 145. The drum shaft 34 is inserted into the bearing 143. The bearing 143 has an inner diameter substantially equal to the outer diameter of the drum shaft 34, is formed in a tubular shape, and is fixed to the outer peripheral surface of the drum shaft 34. The bearing 143 slightly protrudes from the outer surface of the coupling portion 145 toward the outside in the width direction W.

The input gear 144 is engaged with a drive transmission gear (not shown). The input gear 144 is formed in a cylindrical shape and provided with a plurality of outer teeth protruding outward in the radial direction thereof. The plurality of outer teeth are engaged with the drive transmission gear (not shown). The coupling portion 145 couples the bearing 143 and input gear 144. The coupling portion 145 is integrally provided with a gear side coupling portion 146. The gear side coupling portion 146 protrudes from the middle portion of the coupling portion 145 in the axial direction of the coupling portion 145 toward the flange member 135 and is coupled to the inner cylinder of the exposed portion 137 of the flange member 135.

When a driving force is transmitted to the input gear 144 from the motor (not shown) provided in the main body casing 2 through a gear line (not shown), the photosensitive drum 28 is rotated together with the drum gear 142.

The flange member 138 is fixed to the other end (right side end in the front view) of the main drum body 33 and integrally provided with a cylindrical insertion portion 140 and a press fitting portion 141. The drum shaft 34 is inserted into the cylindrical insertion portion 140. The press-insertion portion 141 has a U-shape cross-section, which protrudes outward in the radial direction of the drum shaft 34 from the middle of the insertion portion 140 and is bent toward the outside in the width direction W. Since the press fitting section 141 of the flange member 138 is pressed into the main drum body 33, the flange member 138 is incapable of rotating relative to the main drum body 33.

A spring receiving member 148 is provided on outer side of the flange member 138 in the width direction W and contacts the felt member 134. A spring 147 is provided on the peripheral surface of the insertion portion 140, and interposed between the spring receiving member 148 and the press fitting section 141.

The spring receiving member 148 has a U-shape cross-section that is open toward the flange member 138. The flange member 138 is urged by an elastic force of the spring 147 toward the flange member 135 in a state where the spring receiving member 148 contacts the felt member 134 disposed on the inner surface of the rear side wall 86. As a result, the edge of the bearing 143 of the drum gear 142 contacts the inner surface of the rear side wall 86, thereby positioning the photosensitive drum 28 in the axial (width) direction thereof.

As shown in FIGS. 2 and 5, the upper casing 78 is integrally provided with a top wall 93 having a substantially rectangular plate shape, two upper side walls 94 disposed at both widthwise ends of the top wall 93 and opposing each other across the width thereof, and an upper rear wall 95 disposed on the rear edge of the top wall 93. This construction forms a substantially rectangular shape in a front view that is open on the bottom and on the front and rear sides.

The upper side walls 94 are bent downward from the widthwise edges of the upper rear wall 95 and includes fitting portions 149. Fitting portions 149 protrude downward from lower edges of the upper side walls 94 and has a substantially square shape in a side view. A through-hole 116 is formed in each fitting portion 149 at positions opposite each other in the width direction W. The through-holes 116 accept the insertion of the drum shaft 34 of the photosensitive drum 28. The upper rear wall 95 is bent diagonally downward and toward the rear side from the rear edge of the top wall 93. The upper rear wall 95 forms an obtuse angle with the top wall 93.

A charger support unit 96 is disposed in a front-to-rear midpoint of the top wall 93 for supporting the charger 29. A beam injection part 97 is disposed on the top wall 93 in front of the charger support unit 96 for allowing passage of a laser beam emitted from the scanning unit 19. A cleaning support part 98 is also provided on the top wall 93 and the upper rear wall 95 to the rear of the charger support unit 96 for supporting the cleaning member 32.

As shown in FIG. 2, the charger support unit 96 includes a front holding plate 99 and a rear holding plate 100 disposed at a front-to-rear midpoint of the top wall 93. The front holding plate 99 and rear holding plate 100 oppose each other in the front-to-rear direction with the grid 75 interposed therebetween.

The front holding plate 99 protrudes downward from an inner wall surface of the top wall 93 and extends in the width direction W of the top wall 93. The front holding plate 99 abuts the grid 75 on the front side.

The rear holding plate 100 protrudes downward from the inner wall surface of the top wall 93 and extends in the width direction W of the top wall 93 parallel to the front holding plate 99. The rear holding plate 100 abuts the grid 75 on the rear side thereof. The amount that the rear holding plate 100 protrudes from the top wall 93 is less than the protruding length of the front holding plate 99.

Hence, with the grid 75 interposed between the front holding plate 99 and rear holding plate 100, the front holding plate 99 and rear holding plate 100 grip the grid 75 in the front-to-rear direction. The discharge wire 74 spans between both upper side walls 94 and between the front holding plate 99 and rear holding plate 100.

The beam injection part 97 includes a beam injection opening 101 formed in front of the charger support unit 96 and having a substantially elongated rectangular shape in a plan view, extending in the width direction W, and a front injection plate 102 and a rear injection plate 103 opposing each other in the front-to-rear direction with the beam injection opening 101 formed therebetween.

The front injection plate 102 protrudes at a slant downward and to the rear from the inner wall surface of the top wall 93 and extends in the width direction W of the top wall 93. The front injection plate 102 is disposed on the front side of the beam injection opening 101.

The rear injection plate 103 protrudes downward from the inner wall surface of the top wall 93 and extends in the width direction W of the top wall 93. The rear injection plate 103 is disposed on the rear side of the beam injection opening 101. Further, the rear injection plate 103 protrudes a shorter distance than the front injection plate 102.

In a side view, the beam injection part 97 is substantially triangular-shaped, growing narrower in the downward direction. When the scanning unit 19 emits a laser beam, the laser beam enters the beam injection opening 101, passing between the front injection plate 102 and rear injection plate 103, and is scanned in a high speed over the surface of the photosensitive drum 28.

Next, an assembling method of the drum cartridge 27 will be described with reference to FIGS. 8 through 10.

Firstly, the photosensitive drum 28 is mounted on between both the rear side walls 86 of the lower casing 77, after the transfer roller 31 (FIG. 2) is mounted on the transfer roller receiving portion 88 (FIG. 6). At this time, the edge of the bearing 143 of the drum gear 142 attached to the photosensitive drum 28 is positioned between the pair of guide ribs 132 from above and the peripheral surface of the flange member 138 is positioned to contact the front restriction rib 152. Then, the photosensitive drum 28 is pressed downward. The edge of the bearing 143 and the flange member 138 are moved downward while being guided by the pair of guide ribs 132 and the front restriction rib 152 respectively. Thus, the edge of the bearing 143 and the insertion portion 140 of the flange member 138 are lead to a position where the edge of the bearing 143 and the insertion portion 140 are aligned with the lower drum insertion holes 89 of both the rear side walls 86 in the width direction W respectively. When the edge of the bearing 143 and the insertion portion 140 of the flange member 138 are aligned with the lower drum insertion holes 89 of both the rear side walls 86 in the width direction W respectively, the restriction rib 133 and the flange member 138 contact the bearing 143 and the lower restriction rib 151 respectively, thereby preventing the photosensitive drum 28 from being moved downward further.

Next, as shown in FIG. 8, the upper casing 78 on which the charger 29 and the cleaning member 32 are mounted is assembled on the lower casing 77 on which the photosensitive drum 28 is mounted, in such a manner that the upper casing 78 covers the lower casing 77 from the upper side. At this time, the fitting portions 149 of both the upper side walls 94 of the upper casing 78 are fitted to the receiving grooves 131 formed on the outer surfaces of both the rear side walls 86 of the lower casing 77. As a result, the upper casing 78 is lead to a predetermined position relative to the lower casing 77, so that the through-holes 116 formed in the upper side walls 94 are aligned and communicate with the lower drum insertion holes 89 formed in the rear side wall 86 in the width direction W.

Figure 9:
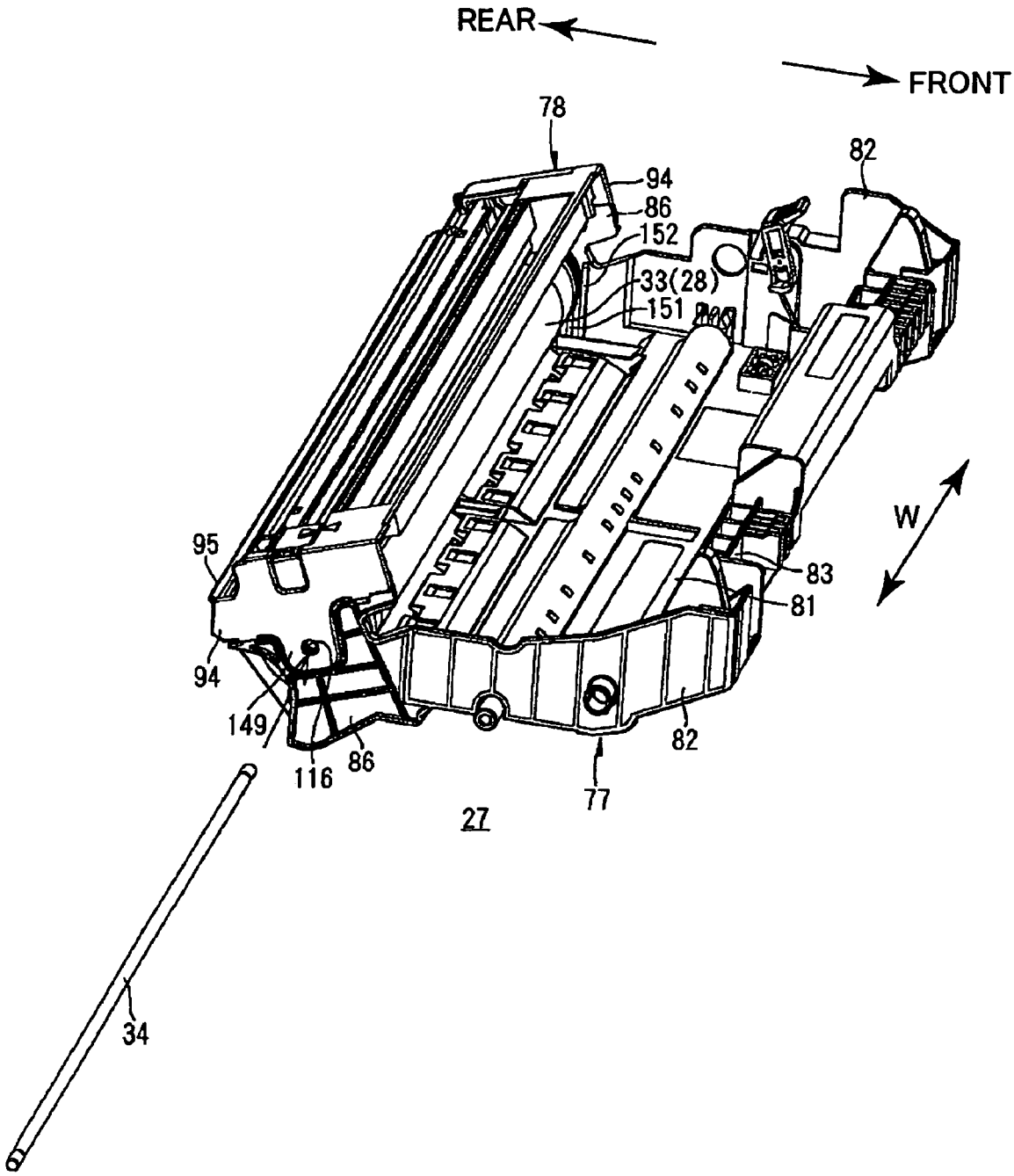
FIG. 9 is a view showing a process of assembling (insertion of drum shaft) the drum cartridge according to the present invention.
Figure 10:
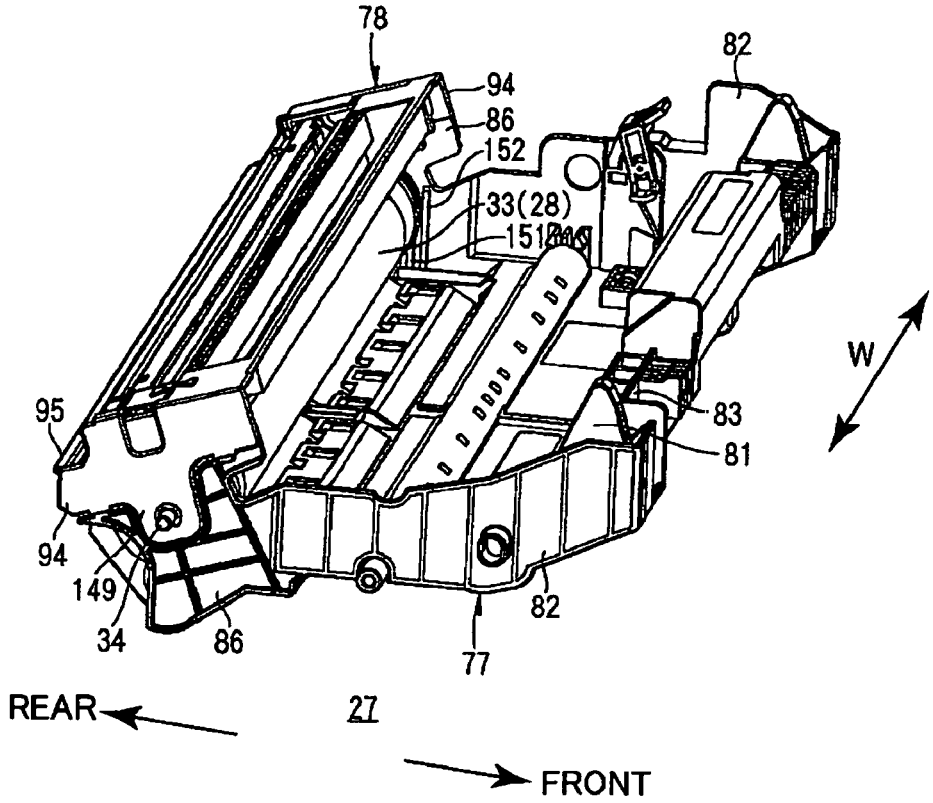
FIG. 10 is a view showing a process of assembling the drum cartridge (state after assembly work) according to the present invention.

Subsequently, as shown in FIG. 9, the drum shaft 34 is inserted through the main drum body 33 of the photosensitive drum 28, the through-holes 116, and lower drum insertion holes 89. In this way, as shown in FIG. 10, the upper casing 78 and lower casing 77 are attached via the drum shaft 34 and assembly work of the drum cartridge 27 is completed.

While the upper casing 78 is attached to the lower casing 77, the support plate 66 contacts the positioning wall 92 provided on the receiving plate 90 of the lower casing 77 (see FIG. 2), thereby fixing the position of the cleaning brush 65 relative to the photosensitive drum 28.

As described above, the upper casing 78 and the lower casing 77 of the drum cartridge 27 are attached to each other by the drum shaft 34 of the photosensitive drum 28. Accordingly, the charger 29 and cleaning member 32 supported by the upper casing 78 and transfer roller 31 supported by the lower casing 77 are arranged on the basis of the position of the drum shaft 34, so that the relative position between the photosensitive drum 28 and the charger 29, cleaning member 32, and transfer roller 31 can be positioned with high accuracy.

The drum shaft 34 is inserted through the main drum body 33 of the photosensitive drum 28, the through-holes 116, and lower drum insertion holes 89 after the upper casing 78 is fitted to the lower casing 77. Accordingly, the photosensitive drum 28 can be positioned relative to the lower casing 77. Further, the charger 29, cleaning member 32, and transfer roller 31 disposed around the photosensitive drum 28 can be positioned relative to the lower casing 77 with high accuracy at a time. Therefore, a work for assembling the drum cartridge 27 can be reduced.

Further, by inserting the drum shaft 34 through the main drum body 33 of the photosensitive drum 28, the through-holes 116, and lower drum insertion holes 89, the upper casing 78 and lower casing 77 can be attached via the drum shaft 34. By drawing out the drum shaft 34 from the main drum body 33 of the photosensitive drum 28, the through-holes 116, the attaching between the upper casing 78 and lower casing 77 can be released (separated). Therefore, the work for assembling and separating the drum cartridge 27 can be reduced.

The pair of guide ribs 132 is provided on the inner surface of the one rear side wall 86 of the lower casing 77. When the photosensitive drum 28 is mounted on the lower casing 77, the pair of guide ribs 132 guides the edge of the bearing 143 of the drum gear 142 attached to the photosensitive drum 28 to the position where the edge of the bearing 143 overlaps the lower drum insertion hole 89 formed on the rear side wall 86 in the width direction W. Further, the front restriction rib 152 is provided on the inner surface of the other rear side wall 86 of the lower casing 77. When the photosensitive drum 28 is mounted on the lower casing 77, the front restriction rib 152 guides the insertion portion 140 of the flange member 138 attached to the photosensitive drum 28 to the position where the insertion portion 140 overlaps the lower drum insertion hole 89 formed on the rear side wall 86 in the width direction W. Therefore, the photosensitive drum 28 can smoothly be disposed between both the rear side walls 86. Further, the guide ribs 132 and front restriction rib 152 guide the photosensitive drum 28 such that the bearing 143 of the drum gear 142 and the insertion portion 140 are aligned with the lower drum insertion holes 89 in the width direction W respectively. Accordingly, the drum shaft 34 can be smoothly inserted through the bearing 143, the insertion portion 140, and lower drum insertion holes 89 after the upper casing 78 is fitted to the lower casing 77.

Figure 11:
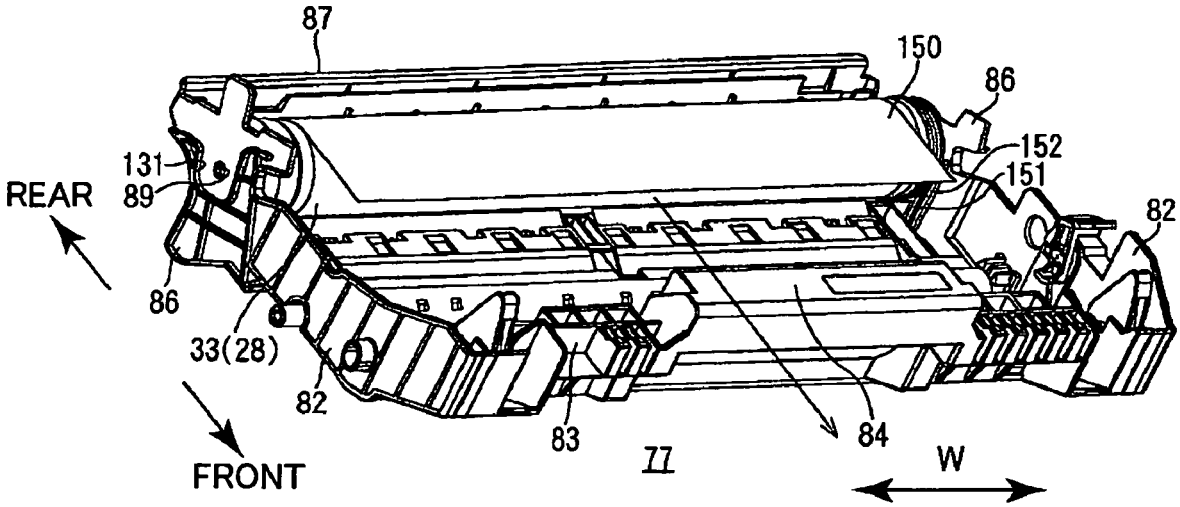
FIG. 11 is a view showing a process of removing a light-shielding paper from a photosensitive drum attached to the drum cartridge shown in FIG. 8.

Further, the pair of guide ribs 132 and front restriction rib 152 are provided on the rear side walls 86. Thus, as shown in FIG. 11, when a light-shielding paper 150 wound on the surface of the main drum body 33 for protecting the surface thereof is pulled for removal from the surface of the main drum body 33 after the photosensitive drum 28 is disposed between both the rear side walls 86, the front side guide ribs 132 and the front restriction rib 152 prevent the photosensitive drum 28 from being moved to the front side, thereby preventing displacement of the position of the photosensitive drum 28.

The receiving groove 131 is formed on the outer surface of each rear side wall 86 of the lower casing 77. When the upper casing 78 is mounted on the lower casing 77, the receiving groove 131 receives a fitting portion 149 of the upper side wall 94 of the upper casing 78. Then, the upper casing 78 is lead to the predetermined position relative to the lower casing 77, so that the through-holes 116 formed in the upper side walls 94 are aligned and communicate with the lower drum insertion holes 89 formed in the rear side wall 86 in the width direction W. Therefore, the upper casing 78 can smoothly be attached to the lower casing 78. Further, the receiving portion 131 guides the upper casing 78 such that the through-holes 116 are aligned with the lower drum insertion holes 89 in the width direction W. Accordingly, the drum shaft 34 can be smoothly inserted through the through-holes 116 and the lower drum insertion holes 89 after the upper casing 78 is fitted to the lower casing 77.

Further, each receiving groove 131 is formed on the outer surface of each rear side wall 86 and each fitting portion 149 of each upper side wall 94 of the upper casing 78 is provided opposite side of the photosensitive drum 28 with respect to each inner surface of the rear side walls 86 of the lower casing 77, that is, provided outer side of the rear side wall 86 in the width direction W. This configuration prevents the fitting portions 149 of the upper side walls 94 from contacting the main drum body 33 or the drum gear 142 of the photosensitive drum 28 when the upper casing 78 is fitted to the lower casing 77.

Further, the guide rib 132 and receiving groove 131 are both integrally provided on the rear side wall 86, thereby reducing the number of parts and simplifying the structure of the lower casing 77.

Further, in the process cartridge 20 including the drum cartridge 27 described above, the relative position between the photosensitive drum 28 and the components disposed around the photosensitive drum 28, such as the charger 29, cleaning member 32, and transfer roller 31 can be positioned with high accuracy. Further, the work for assembling and separating the process cartridge 20 including the drum cartridge 27 can be reduced.

Further, the laser printer 1 including the drum cartridge 27 capable of positioning the relative position between the photosensitive drum 28 and the components disposed around the photosensitive drum 28, such as the charger 29, cleaning member 32, and transfer roller 31 can achieve high-quality developer image formation, thereby achieving high-quality image formation on the paper 3.

While the developer cartridge 30 can be mounted into or removed from the drum cartridge 27, the developer cartridge 30 may be integrally formed with the drum cartridge 27 (i.e., the developer cartridge 30 cannot be mounted into or removed from the drum cartridge 27).

What is claimed is:

1. An image carrying cartridge comprising:

a shaft defining an axial direction;

an image carrying member carrying a developer image, the image carrying member being formed with a shaft insertion-hole extending in the axial direction through which the shaft is inserted and having one end and another end in the axial direction;

a first casing comprising two first walls arranged in parallel to each other and having surfaces perpendicular to the axial direction of the shaft, one first wall opposing the one end of the image carrying member in the axial direction, another first wall opposing the other end of the image carrying member in the axial direction, each of the first walls being formed with a first through-hole; and a second casing comprising two second walls arranged in parallel to the two first walls, one second wall opposing the one first wall in the axial direction, another second wall opposing the other first wall in the axial direction, each of the second walls being formed with a second through-hole, the first casing and the second casing being coupled by insertion of the shaft through the first though-hole and the second through-hole to provide an inner space in which the image carrying member is accommodated;

wherein the one second wall is interposed between the one end of image carrying member and the one first wall, the other second wall is interposed between the other end of the image carrying member and the other first wall, the one second wall comprising a guide portion provided on a surface opposite to the one end of the image carrying member of the one second wall, the guide portion being configured to guide the image carrying member at a position where the shaft insertion-hole is aligned with the second through-hole in the axial direction, when the image carrying member is disposed between the two second walls; and each of the second walls comprises a casing guide portion provided on a surface opposite to each of the first walls of each of the second walls, the casing guide portion being configured to guide the first casing at a position where the first through-holes are aligned with the second through-holes in the axial direction, when the second casing is coupled to the first casing.

2. The image carrying cartridge according to claim 1, wherein the guide portion is integrally provided on the one second wall.

3. The image carrying cartridge according to claim 1, wherein the casing guide portions are integrally provided on the second walls.

4. The image carrying cartridge according to claim 1, further comprising:

a charger that is supported on the first casing and charges a surface of the image carrying member;

a cleaning member that is supported on the first casing and removes matter adhered to the surface of the image carrying member; and a transfer member that is supported on the second casing and transfers a developer image carried on the image carrying member onto a transfer medium;

wherein the charger, the cleaning member and the transfer member are accommodated in the inner space.

5. A process cartridge comprising:

an image carrying cartridge comprising, a shaft defining an axial direction;

an image carrying member carrying a developer image, the image carrying member being formed with a shaft insertion-hole extending in the axial direction through which the shaft is inserted and having one end and another end in the axial direction;

a first casing comprising two first walls arranged in parallel to each other and having surfaces perpendicular to the axial direction of the shaft, one first wall opposing the one end of the image carrying member in the axial direction, another first wall opposing the other end of the image carrying member in the axial direction, each of the first walls being formed with a first through-hole; and a second casing comprising two second walls arranged in parallel to the two first walls, one second wall opposing the one first wall in the axial direction, another second wall opposing the other first wall in the axial direction, each of the second walls being formed with a second through-hole, the first casing and the second casing being coupled by insertion of the shaft through the first though-hole and the second through-hole to provide an inner space in which the image carrying member is accommodated, and a developer cartridge that supplies a toner to the image carrying member;

wherein the one second wall is interposed between the one end of image carrying member and the one first wall, the other second wall is interposed between the other end of the image carrying member and the other first wall, the one second wall comprising a guide portion provided on a surface opposite to the one end of the image carrying member of the one second wall, the guide portion being configured to guide the image carrying member at a position where the shaft insertion-hole is aligned with the second through-hole in the axial direction, when the image carrying member is disposed between the two second walls; and each of the second walls comprises a casing guide portion provided on a surface opposite to each of the first walls of each of the second walls, the casing guide portion being configured to guide the first casing at a position where the first through-holes are aligned with the second through-holes in the axial direction, when the second casing is coupled to the first casing.

6. An image forming device comprising:

a main frame; and an image carrying cartridge disposed in the main frame, comprising, a shaft defining an axial direction;

an image carrying member carrying a developer image, the image carrying member being formed with a shaft insertion-hole extending in the axial direction through which the shaft is inserted and having one end and another end in the axial direction;

a first casing comprising two first walls arranged in parallel to each other and having surfaces perpendicular to the axial direction of the shaft, one first wall opposing the one end of the image carrying member in the axial direction, another first wall opposing the other end of the image carrying member in the axial direction, each of the first walls being formed with a first through-hole; and a second casing comprising two second walls arranged in parallel to the two first walls, one second wall opposing the one first wall in the axial direction, another second wall opposing the other first wall in the axial direction, each of the second walls being formed with a second through-hole, the first casing and the second casing being coupled by insertion of the shaft through the first though-hole and the second through-hole to provide an inner space in which the image carrying member is accommodated;

wherein the one second wall is interposed between the one end of image carrying member and the one first wall, the other second wall is interposed between the other end of the image carrying member and the other first wall, the one second wall comprising a guide portion provided on a surface opposite to the one end of the image carrying member of the one second wall, the guide portion being configured to guide the image carrying member at a position where the shaft insertion-hole is aligned with the second through-hole in the axial direction, when the image carrying member is disposed between the two second walls; and each of the second walls comprises a casing guide portion provided on a surface opposite to each of the first walls of each of the second walls, the casing guide portion being configured to guide the first casing at a position where the first through-holes are aligned with the second through-holes in the axial direction, when the second casing is coupled to the first casing.

7. An image forming device comprising:

a main frame; and a process cartridge provided in the main frame, comprising, an image carrying cartridge comprising, a shaft defining an axial direction;

an image carrying member carrying a developer image, the image carrying member being formed with a shaft insertion-hole extending in the axial direction through which the shaft is inserted and having one end and another end in the axial direction;

a first casing comprising two first walls arranged in parallel to each other and having surfaces perpendicular to the axial direction of the shaft, one first wall opposing the one end of the image carrying member in the axial direction, another first wall opposing the other end of the image carrying member in the axial direction, each of the first walls being formed with a first through-hole; and a second casing comprising two second walls arranged in parallel to the two first walls, one second wall opposing the one first wall in the axial direction, another second wall opposing the other first wall in the axial direction, each of the second walls being formed with a second through-hole, the first casing and the second casing being coupled by insertion of the shaft through the first though-hole and the second through-hole to provide an inner space in which the image carrying member is accommodated, and a developer cartridge that supplies a toner to the image carrying member;

wherein the one second wall is interposed between the one end of image carrying member and the one first wall, the other second wall is interposed between the other end of the image carrying member and the other first wall, the one second wall comprising a guide portion provided on a surface opposite to the one end of the image carrying member of the one second wall, the guide portion being configured to guide the image carrying member at a position where the shaft insertion-hole is aligned with the second through-hole in the axial direction, when the image carrying member is disposed between the two second walls; and each of the second walls comprises a casing guide portion provided on a surface opposite to each of the first walls of each of the second walls, the casing guide portion being configured to guide the first casing at a position where the first through-holes are aligned with the second through-holes in the axial direction, when the second casing is coupled to the first casing.

* * * * *